United States Patent [19]

Sepulveda

[11] 4,435,624

[45] Mar. 6, 1984

[54] LOCK OFF-LOCK ON

[75] Inventor: Luis F. Sepulveda, Fajardo, P.R.

[73] Assignees: Challenger Caribbean Corporation, Canovanas; Challenger Products Corporation, Rio Piedras, both of P.R.; Commander Electrical Equipment, Inc., Scarborough, Canada

[21] Appl. No.: 421,754

[22] Filed: Sep. 23, 1982

[51] Int. Cl.[3] ..... H01H 9/24

[52] U.S. Cl. ..... 200/42 T; 200/321; 200/334

[58] Field of Search ..... 200/42 T, 44, 321, 322, 200/327, 334

[56] References Cited

U.S. PATENT DOCUMENTS

| | | | |
|---|---|---|---|
| 2,832,857 | 4/1958 | Landmeier | 200/42 T |
| 2,849,552 | 8/1958 | Firestone | 200/44 X |
| 2,937,248 | 5/1960 | Michetti | 200/42 T |
| 3,408,466 | 10/1968 | Palmer | 200/42 T |
| 3,909,764 | 9/1975 | Belttary | 335/45 X |
| 4,300,030 | 11/1981 | Dimarco | 200/42 T |

*Primary Examiner*—John W. Shepperd
*Assistant Examiner*—Renee S. Kidorf
*Attorney, Agent, or Firm*—Frederick A. Zoda; John J. Kane

[57] ABSTRACT

A lock off-lock on for a handle of an electric circuit breaker includes a unitary metallic member having a first handle engaging portion adapted to be inserted into an opening of a circuit breaker handle. The opening can be provided in a direction perpendicular to the reciprocating movement path of the handle between "on" and "off" positions. The member includes a second handle engaging portion joined to the first portion by a bight to form a U-shaped structure. The second handle engaging portion engages a surface of the handle which is in exposed adjacency to a dependent arcuate portion which is in proximal relationship with the interior of a slot in the housing in which the handle outwardly extends. A flat spring, coupled to a part of one side of the second portion by an angular bend, is engageable with the dependent arcuate portion and is in abutting relationship with the housing at one of the edges of the slot. A flange is coupled to the flat spring proximal to the bight and is bent outwardly away from the housing so as to facilitate removal of the lock off-lock on from the handle. The handle engaging portion includes flash piercing means at a free end of the portion.

10 Claims, 7 Drawing Figures

LOCK OFF-LOCK ON

BACKGROUND OF THE INVENTION

1. Field of the Invention

This invention relates to a lock off-lock on, or a restraint, for preventing inadvertent operation of a circuit breaker operating handle. Accordingly, it is a general object of this invention to provide new and improved devices of such character.

2. General Background

A circuit breaker, to which this invention is applicable, is described in U.S. Pat. No. 3,904,998, issued to Harold E. Belttary on Sept. 9, 1975. The circuit breaker includes a housing of insulating material, various internal components, and a manually movable handle mounted in the housing. The housing comprises a case of suitable insulating material and a cover of suitable material. The case and cover are typically of molded plastic. The handle, of insulating material, is pivotally mounted within the case in a conventional manner for manual operation. The handle extends outwardly from a slot in the case with a dependent arcuate portion of the handle in proximal relationship with the interior of the slot. The handle of the circuit breaker is adapted to have an aperture therethrough transverse to the direction of movement of the handle so as to facilitate ganging of handles when a plurality of breakers are ganged together; in single usage, the handle of a breaker would have its aperture occluded by flash in the molding process.

Though multi-pole lock offs-lock ons are commercially available, it is desirable to provide a restraint for locking on, or locking off, the handle of a circuit breaker.

When a homeowner desires to repair an electrical fault in his house, he would normally switch the appropriate circuit breaker to the off position so that the fault could be safely repaired. To assure that some other party, a child or spouse for example, would not inadvertently throw the switch handle into the "on" position, it becomes desirable to restrain the switch into its "off" position with a "lock off" or restraint.

SUMMARY OF THE INVENTION

Another object of this invention is to provide a new and improved lock off-lock on formed in a one piece metal stamping.

Yet another object of this invention is to provide a new and improved lock off-lock on which is inexpensive and reusable.

Still another object of this invention is to provide a new and improved lock off-lock on which is press fitted and which is large enough for ease of visibility.

In accordance with one embodiment of the invention, a lock off-lock on for a handle of an electrical circuit breaker includes a unitary member formed from a metallic sheet. The member includes a first handle engaging portion adapted to be inserted into an opening of the handle. The opening is adapted to be provided therethrough in a direction perpendicular to the path of reciprocating movement of the handle between "on" and "off" positions. The member includes a second handle engaging portion joined to the first portion by a bight to form a U-shaped structure. The second handle engaging portion is suitable for engagement with a surface of the handle which is in exposed adjacency to a dependent arcuate portion which is in proximal relationship with the interior of a slot in the housing case from which the handle outwardly extends. A flat spring is coupled to a part of one side of the second portion by an angular bend so that the spring is engageable with the dependent arcuate portion and in abutting relation with the case at one of the edges of the slot. A flange that is coupled to the flat spring proximal to the bight is bent outwardly away from the housing so as to facilitate removal of the lock off-lock on from the handle. In accordance with certain features of the invention, the first handle engaging portion includes flash piercing means, such as a V-shaped cut in a free end of the portion. The angular bend of the flat spring can be 45°. The flange can form a 30° angle with respect to the flat spring.

In accordance with another embodiment of this invention, a lock off-lock on includes a unitary member formed from a metallic sheet comprising a U-shaped member. A free end of one leg of the U-shaped member is formed with piercing edges. The two legs of the member are joined together by a bight. A portion of one side of the U-shaped member, distant from the bight, is coupled by an angular bend to a flat spring. A flange, coupled to the flat spring, is bent outwardly therefrom. In accordance with certain features of the invention, the free end of the leg has a V-shaped cut formed therein. The cut can be formed with an interior angle of 90°. The angular bend can be 45°. The flange can form a 30° angle with respect to the flat spring.

BRIEF DESCRIPTION OF THE DRAWING

Other objects, advantages, and features of this invention, together with its construction and mode of operation, will become more apparent from the following description, when read in conjunction with the accompanying drawing, in which.

DESCRIPTION OF A PREFERRED EMBODIMENT

Figure 1:
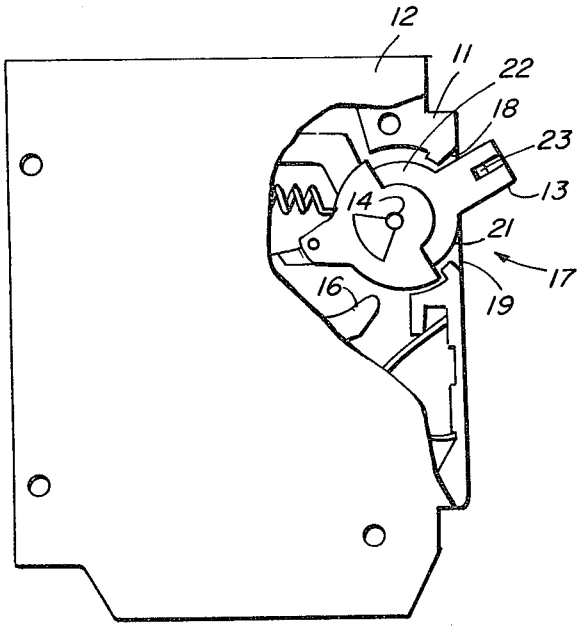
FIG. 1 is a side elevational view of a circuit breaker, with the cover in place but with portions broken away, having its handle in the closed contact or "on" position, the circuit breaker being suitable for receiving a lock off-lock on of this instant invention.

A circuit breaker, to which this invention is especially applicable (as stated hereinabove) and which is described in U.S. Pat. No. 3,904,998 to Harold E. Belttary on Sept. 9, 1975, includes a housing formed of a case 11 and engaging cover 12 of suitable insulating material such as molded plastic. A manually movable handle 13 is pivotally mounted in the housing about an axis 14. The circuit breaker further includes a plurality of internal components 16 such as a contact carrier, a trip arm, an overcenter tension spring, a loaded spring, a thermostat element and the like, all of which are not necessarily shown as they are not essential for an understanding of this invention.

The handle 13 extends outwardly from a slot 17 that has an upper edge 18 and a lower edge 19. In the "on" position (FIG. 1), the handle 13 extends outwardly therefrom with a dependent arcuate portion 21 thereof in proximal relationship with the interior of the slot 17. In like fashion, when the handle 13 is in the "off" position (FIG. 2), a dependent arcuate portion 22 of the handle 13 is in proximal relationship with the interior of the slot 17.

Figure 2:
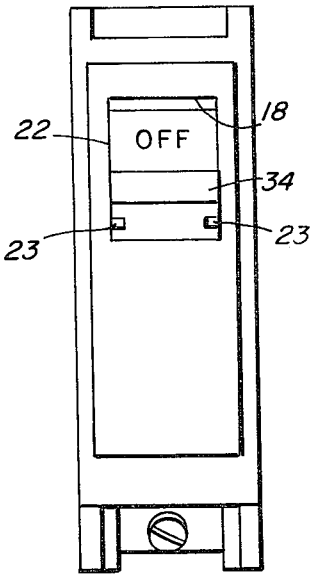
FIG. 2 is an end view of the circuit breaker depicted in FIG. 1 but with the handle being depicted in the "off" position, that is, the contacts of the circuit breaker are open circuited.

The handle 13 of the circuit breaker is adapted to have an aperture 23 therethrough transverse to the direction of movement of the handle, i.e., the principal axis of the aperture is perpendicular to the paper as viewed in FIG. 1 and toward the right as viewed in FIG. 2. Such an aperture is advantageous when a plurality of breakers are utilized, especially when it is desired to operate the circuit breakers in a ganged manner. The handle of a circuit breaker used solely for single phase operation normally would have its aperture occluded by flash in the plastic molding process. The flash can be pierced by a sharp implement.

Figure 3:
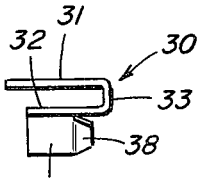
FIGS. 3, 4, and 5 are top, front and side views, respectively, of a lock off-lock on in accordance with one embodiment of this invention.
Figure 4:
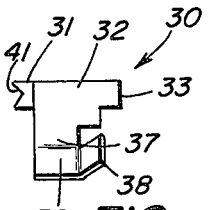
Figure 5:
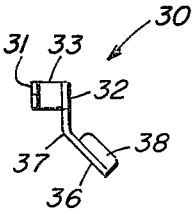

A lock off-lock on, in accordance with this invention, is constructed of an integral sheet of metal, preferably by a pressing or stamping operation. The lock off-lock on 30, as depicted in FIGS. 3, 4, and 5, is a one piece metal stamping that can be press fitted; it is inexpensive, reusable and is sufficiently large for ease of visibility. It is adapted to prevent inadvertent operation of a circuit breaker handle from "off" to "on" as described hereinafter (or, alternatively, from "on" to "off"), all without the necessity of altering either a circuit breaker case or the circuit breaker handle.

Figure 6:
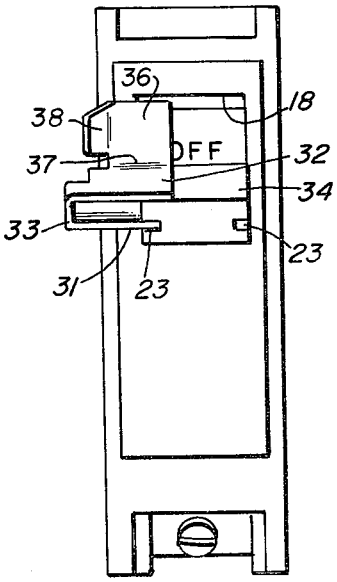
FIGS. 6 and 7 are end views, respectively, of the circuit breaker depicted in FIG. 2 with the lock off-lock on of FIGS. 3–5 being initially applied and being completely applied thereto, respectively.

The lock off-lock on 30, as depicted in FIGS. 3, 4, and 5, includes a first handle engaging portion 31 which is adapted to be inserted into the opening 23 of the handle 13 (FIG. 6). The member 30 further includes a second handle engaging portion 32 which is joined to the first portion 31 by a bight 33 to form a U-shaped structure.

The second handle engaging portion 32 is adapted to engage with that surface 34 of the handle 13 which is in exposed adjacency to the dependent arcuate portion 22 of the handle 13.

The dependent arcuate portion 22 is in proximal relationship with the interior of the slot 17 in the housing case 11 from which the handle 13 outwardly extends.

A flat spring 36 is coupled to part of one side of the second portion 32 by an angular bend along a line 37 so that it is engageable with the dependent arcuate portion 22 and in abuttable relation with the case 11 at an edge 18 of the slot 17.

A flange 38, proximal to the bight 33, is coupled to the flat spring 36. The flange 38 is bent in such a direction, that when the lock off-lock on 30 engages a circuit breaker, the flange 38 veers outwardly away therefrom so as to facilitate removal of the lock off-lock on 30 from the handle 13.

The first handle engaging portion 31 includes flash piercing means 41 which can be provided by a V-shaped cut at the free end of the portion 31. The angular bend of the flat spring 36 along the line 37 can be 45°. The flange 38 can form a 30° angle with respect to the flat spring 36.

In brief summary, the lock off-lock on 30 includes a unitary member formed from a metallic sheet comprising a U-shaped member. The free end of one leg 31 of the U-shaped member is formed with piercing edges, as by the V-shaped cut 41. The two legs 31, 32 of the member are joined together by the bight 33. A portion distant from the bight 33 of one side of the leg 32 of the U-shaped member is coupled by the angular bend 37 to the flat spring 36. The flange 38 is coupled to the flat spring 36 and is bent outwardly therefrom. The cut 41 can be formed with an interior angle of 90°; the angular bend can be 45°, and the flange can form a 30° angle with respect to the flat spring 36.

Figure 7:
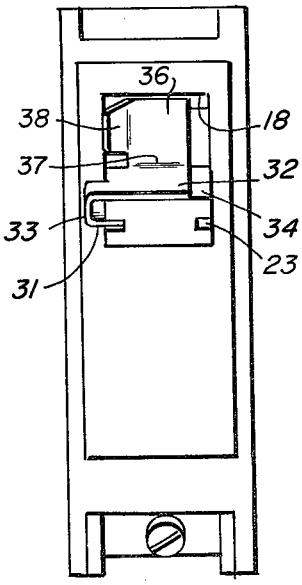

In usage, FIG. 2 depicts an end view of a circuit breaker with the handle 13 in the "off" position, prior to a lock off-lock on 30 of this invention being applied thereto. FIG. 6 depicts the same circuit breaker with the lock off-lock on 30 being initially applied to the handle 13 thereof, with the portion 31 entering the opening 23 of the handle 13. FIG. 7 illustrates the circuit breaker with the lock off-lock on 30 slid completely onto the handle 13 so as to restrain it in its "off" position.

It will be apparent to those ordinarily skilled in the art to which this invention pertains that when the handle 13 is switched to the "on" position (that is, as depicted in FIG. 1, with the handle 13 up as viewed), the lock off-lock on 30 can be applied in similar fashion to lock the the handle 13 in the "on" position.

Although it is contemplated that various materials are suitable for the practice of the invention, in a preferred mode 0.03" thick zinc plated steel has been found to be efficacious, with the lock off-lock on 30 being heat treated and baked to prevent hydrogen embrittlement.

Various modifications can be made without departing from the spirit and scope of this invention, it being contemplated that this invention be limited solely by the scope of the allowed claims.

What is claimed is:

1. A lock off-lock on for a handle of an electrical circuit breaker, the circuit breaker including a housing comprising a case of suitable insulating material having a slot formed therein including defined opposing edges and an insulative cover for engaging said case, said handle being manually movable and pivotally mounted within said case and extending outwardly from said slot with a dependent arcuate portion of said handle in proximal relationship with the interior of said slot, said handle being adapted for reciprocation about a partial arcuate path between "on" and "off" positions, said handle being adapted to have an opening therethrough in a direction perpendicular to said path, said lock off lock on comprising a unitary member formed from a metallic sheet comprising a first handle engaging portion adapted to be inserted into said opening of said handle;

a second handle engaging portion, joined to said first portion by a bight to form a U-shaped structure, for engagement with a surface of said handle which is in exposed adjacency to said dependent arcuate portion;

flat spring means coupled to a part of one side of said second portion by an angular bend so that said flat spring means is engageable with said dependent arcuate portion and in abutting relation with said case at one of said edges of said slot; and a flange, coupled to said flat spring means proximal to said bight, bent outwardly away from said housing so as to facilitate manual removal of said lock off-lock on from said handle.

2. The lock off-lock on as recited in claim 1 wherein said first handle engaging portion includes flash piercing means.

3. The lock off-lock on as recited in claim 2 wherein said flash piercing means includes a V-shaped cut in a free end of said first portion.

4. The lock off-lock on as recited in claim 1 wherein said angular bend of said flat spring means is 45°.

5. The lock off-lock on as recited in claim 1 wherein said flange forms a 30° angle with respect to said flat spring means.

6. A lock off-lock on comprising a unitary member formed from a metallic sheet comprising a U-shaped member having a first leg and a second leg joined together by a bight, said first leg having a free end formed with piercing edges, and said second leg having a portion of one side thereof, away from said bight, coupled by an angular bend to flat spring means, and having a flange coupled to said flat spring means and bent outwardly therefrom.

7. The lock off-lock on as recited in claim 6 wherein said free end of said first leg has a V-shaped cut formed therein.

8. The lock off-lock on as recited in claim 7 wherein said V-shaped cut forms an interior angle of 90°.

9. The lock off-lock on as recited in claim 6 wherein said angular bend is 45°.

10. The lock off-lock on as recited in claim 6 wherein said flange forms a 30° angle with respect to said flat spring means.

* * * * *